US006614876B1

(12) United States Patent
Kirk

(10) Patent No.: US 6,614,876 B1
(45) Date of Patent: Sep. 2, 2003

(54) SYSTEM FOR X-RAY IRRADIATION

(76) Inventor: Randol E. Kirk, 8208 NW. 6th St., Coral Springs, FL (US) 33071

( * ) Notice: Subject to any disclaimer, the term of this patent is extended or adjusted under 35 U.S.C. 154(b) by 0 days.

(21) Appl. No.: 10/244,209

(22) Filed: Sep. 16, 2002

(51) Int. Cl.[7] ..... G21K 5/00
(52) U.S. Cl. ..... 378/64
(58) Field of Search ..... 378/64–69

(56) References Cited

U.S. PATENT DOCUMENTS 6,212,255 B1 * 4/2001 Kirk ..... 378/66
6,389,099 B1 * 5/2002 Gueorguiev ..... 378/64

* cited by examiner

*Primary Examiner*—Craig E. Church
(74) *Attorney, Agent, or Firm*—Leo J. Aubel

(57) ABSTRACT

A blood irradiator for providing a uniform dose of X-ray beam irradiation for blood products contained within bags positioned in a cannister. A first X-ray tube is positioned to irradiate said bags from one surface of the bags, and a second X-ray tube is positioned to irradiate said bags from the opposite surface of said bags concurrently with said first tube. A low Z high density material collar mounted around said cannister to reflect X-rays. The X-rays from the two tubes and the reflected X-rays combine to provide a uniform dose of X-rays to said bags.

9 Claims, 1 Drawing Sheet

SYSTEM FOR X-RAY IRRADIATION

BACKGROUND OF THE INVENTION

The present application is related to, and an improvement on, U.S. Pat. No. 6,212,255 issued to Randol E. Kirk, the inventor herein, which patent is incorporated herein by reference in its entirety.

As stated in the aforesaid patent, X-Ray irradiation of blood product is one of the methods approved by the U.S. Food and Drug Administration for providing a product which diminishes the chance of transfusion-induced diseases. For this purpose, the radiation dose and dose distributions that may occur from X-ray sources must be controlled accurately. X-rays are widely used for such purposes since equipment for providing the X-rays is relatively safe, and also, the equipment for providing the X-rays is comparatively inexpensive as compared to the other types of blood purification.

As disclosed in U.S. Pat, No. 6,389,099, it has been established that a low Z (atomic number) high density material such as carbon, graphite, or boron carbide will reflect X-rays, and these reflected X-rays may be utilized to enhance irradiation energy provided to the product, article or material being irradiated.

SUMMARY OF INVENTION

In a preferred embodiment of the invention a uniform dose of X-ray beam irradiation is provided to blood product contained in blood transfusion bags. The bags is placed in a selected cannister for receiving the X-ray beam, and the system includes two X-ray tubes positioned to irradiate the bags from opposite sides. Importantly, a collar of low Z high density material is placed around the material being irradiated; this causes a portion of each X-ray beam (a portion that normally would not irradiate the material) to impinge on the collar and be reflected back onto the material; thus a larger percentage of the beam energy is utilized. The present invention provides approximately a three times improvement in throughput (actual volume of output per a given time) over the prior art.

The foregoing features and advantages of the present invention will be apparent from the following more particular description of the invention. The accompanying drawings, listed herein below, are useful in explaining the invention.

DESCRIPTION OF THE INVENTION

Figure 1:
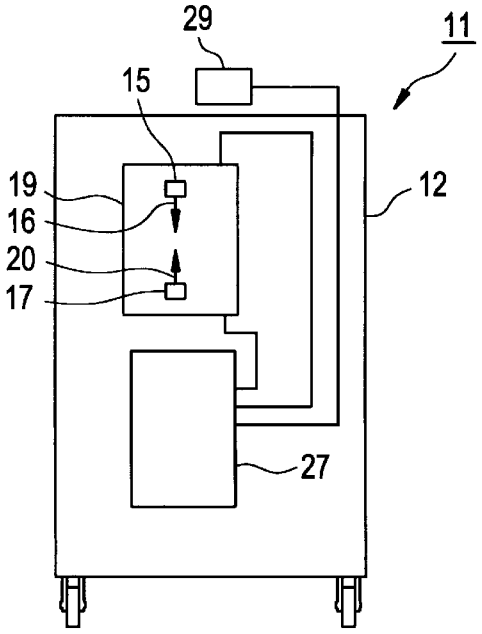
FIG. 1 is a view showing a outline of a basic structure of the inventive system.

The present invention provides an apparatus for insuring dose uniformity for a product, article or material that receives X-ray beam radiation from X-ray tubes. For purpose of description of a preferred embodiment the invention discloses a system or product for irradiating blood contained in a transfusion bags wherein the bags are all irradiated from opposite sides. It should be understood that the invention may be used to irradiate other materials or products and also that a single X-ray tube may be utilized. However, the two tube configuration described herein has been found practical and efficient. The described configuration further uses a single power source for the two X-ray tubes; a separate power source for each X-ray tube is feasible.

Referring to FIGS. 1, 2, 3 and 4, the inventive X-ray system 11 comprises a suitably shielded apparatus or machine 12, which may be portable. The machine 12 includes a first X-ray tube 15 which is oriented to provide a beam of X-rays downwardly (indicated by the line 16) within a chamber 19 which is adapted to receive a cannister or container 18 for blood product bags 22. The system includes suitable known radiation security switches, not shown, so that X-ray irradiation can be initiated only when all the irradiation doors have been closed, as is well known.

The cannister 18 (see FIG. 4) has an circular shaped interior for receiving transfusion bags indicated generally as 22, and includes a cover or top 21. The cannister 18 is dimensioned and positioned to receive up to three standard blood product transfusion bags 22. In the embodiment shown the cannister is 10 cm deep and has a diameter of 12 cm.

Figure 3:
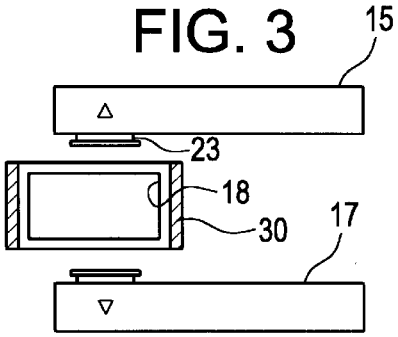
FIG. 3 is a sketch showing the positioning of the Xray tubes relative to a cannister and the reflector collar of embodiment shown in FIG. 1.
Figure 4:
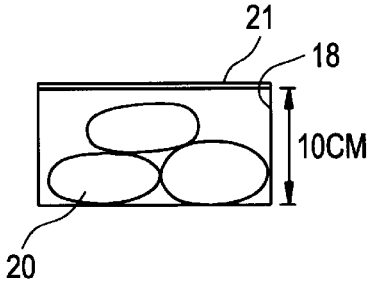
FIG. 4 is a sketch of an embodiment of the invention depicting blood transfusion bags in the cannister.

Referring to FIGS. 1 and 3, X-ray tube 15 has an output of 160 kV; the X-ray beam output port 23 of tube 15 is designed to provide a relatively wide X-ray beam directed downwardly and of a sufficiently large diameter, i.e., a maximum angle beam, to fully cover the cannister 18 and the included bags 22, as will be discussed. In one embodiment, X-ray tube 15 provides a 45+ degree beam. The output window of the X-ray tube 15 is positioned relatively close, about 1 cm from outer upper (cover or lid 21) surface of cannister 18 to assure that maximum energy is delivered to the bags 22. As is known, the closer an X-ray source is to the object to be irradiated, the higher the energy delivered to the object; that is, the level of the energy delivered to the object is dependent on the distance between the two components. As is also known, the object can be irradiated faster when more energy is delivered to the object.

It is of particular importance that the irradiation received by the blood product in bags 22 be uniform. The blood in all bags must be fully irradiated; that is, irradiation energy within a specified range must be provided to the blood for the same period of time to meet Federal regulations. For this purpose of providing an efficient and uniform irradiation of the blood product bags, a second X-ray tube 17 is mounted to provide X-ray irradiation to the opposite end of the cannister 18. The X-ray tube 17 is essentially identical to X-ray tube 15, and mounted in a position to direct its X-ray beam upwardly toward the cannister 18. Tube 17 is positioned approximately the same relative distance from the cannister as is tube 15. Hence, the bags 22 are concurrently irradiated with the same energy from two opposite sides.

Figure 2:
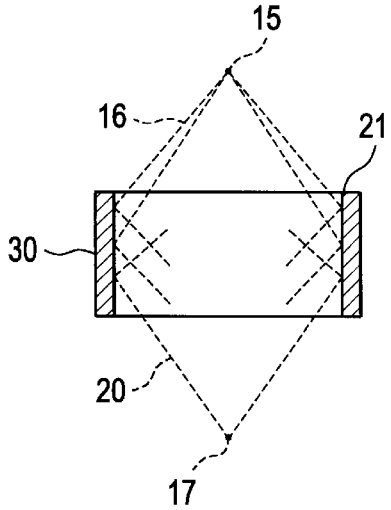
FIG. 2 shows an X-ray reflector collar as mounted in the embodiment of the invention depicted in FIG. 1.

Importantly, a collar 30 of low Z (atomic number), high density material such as boron carbide, boron, or carbon (graphite) is mounted around the cannister 18 within chamber 19, see FIGS. 2 and 3. As is disclosed in U.S. Pat. No. 6,389,099, it has been found that X-rays are usefully reflected from the aforementioned low Z high density material.

As shown in FIG. 2, the irradiation energy from X-ray tube 17 complements the irradiation energy from X-ray tube 15. Since the energy level varies as the beam penetrates the bags of blood; the energy provided changes with the depth or thickness of the blood in bags 22. The energy from tube 15 is maximum at the top surface of cannister 18 and decreases as it penetrates the bags 22, and is effectively at a minimum level at the lower surface of bags 22. Conversely, the radiation energy from X-ray tube 17 is maximum at the lower surface of cannister 18 and decreases to a minimum at the top surface of bags 22. The relation of the irradiation energy at any level or depth of bags 22 is a sum of the energy developed by the two tubes.

Further, the collar 30 reflects the X-rays (those X-ray on the outer portions of the beams 16 from tube 15 and beams 20 from tube 17) that impinge on the inner surface of the collar to thereby utilize essentially the entire X-ray beams from both X-ray tubes. The X-ray energies, that is the X-rays from tube 15, the X-rays of tube 15 reflected by collar 30, the X-rays from tube 17, and the X-rays of tube 17 reflected by collar 30 are effectively combined and concentrated on the bags 22 in cannister 18. Further, as described in the aforesaid Patent No. 6,389,099 some of the X-rays which penetrate the product are reflected back from the collar to re-irradiate the product.

In practice, it has been found that irradiation of a single blood product bag 22 for about six minutes with the apparatus disclosed in prior art U.S. Pat. No. 6,212,255 cited above complies with Federal regulations. In contrast, in the present invention, and by utilizing the reflector collar and utilizing a maximum angle X-ray beam, as indicted in FIG. 4, three bags can be irradiated in seven minutes and still comply with the same Federal regulations. That is, there is an approximately a three times improvement in throughput over the prior art.

Figure 5:
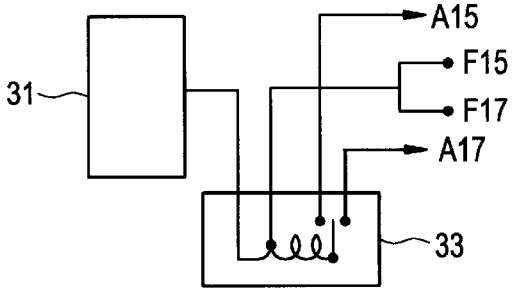
FIG. 5 PRIOR ART
FIG. 5 is a schematic of one known type of a single power source for energizing two X-Rays tubes indicated in FIGS. 1 and 3.

FIG. 5, labeled prior art, shows (in simplified form)a useful type of switching power supply or power generator wherein a single source of power 31 is connected through a switching control 33 that provides power for the two X-ray tubes 15 and 17. As can be appreciated from the circuit, in operation the filaments labeled F15 and F17 in FIG. 5 are continually On and the anodes labeled A15 and A17 of tubes 15 and 17, respectively, are alternately turned On and Off.

The 160 kV tubes used in one embodiment of the invention are commercially available tubes with known characteristics and are manufactured by various commercial sources. It should, of course, be understood that the invention is not limited to any specific output of the X-ray tubes.

While the invention has been particularly shown and described with reference to a particular embodiment thereof it will be understood by those skilled in the art that various changes in form and detail may be made therein without departing from the spirit and scope of the invention.

What is claimed is:

1. An X-ray irradiator for providing a uniform dose of X-ray beam irradiation, said irradiator comprising in combination;

a) a chamber for mounting items to be irradiated;

b) an X-ray tube mounted to irradiate said items; and c) a collar of a low Z high density material mounted adjacent said chamber so as to reflect X-rays from said tube onto said items.

2. An X-ray irradiator for providing X-ray beams to irradiate items, said irradiator comprising in combination, a) a chamber for containing said items;

b) first and second X-ray tubes mounted to provide irradiation to opposite surfaces of said items; and c) a collar of low Z high density material mounted around a cannister to reflect X-rays from said tubes to said items;

d) the irradiation of said tubes, and the reflected irradiation from said collar effectively combining to provide total uniform irradiation to said items.

3. An X-ray irradiator as in claim 2 wherein said X-ray tubes each provide a beam of radiation to fully cover the area of said chamber.

4. An X-ray irradiator for providing a uniform dose of X-ray beam irradiation to blood product transfusion bags, said irradiator comprising in combination, a) a chamber for mounting said transfusion bags;

b) X-ray tubes mounted on opposed sides of said chamber; said tubes providing X-ray beams of radiation to said bags from opposite sides of said bags;

c) said tubes each providing radiation at a same selected energy level to said bags to thereby provide a total radiation energy to said bags which is substantially uniform throughout each of said bags; and d) a collar of a low Z high density material mounted around a cannister to further reflect X-rays onto said bags.

5. An X-ray irradiator as in claim 4 wherein a cannister is mounted in said chamber, said cannister being dimensioned to contain said bags, and said cannister being of a plastic material which absorbs minimal X-ray energy.

6. A system as in claim 4 wherein said X-ray tubes are each mounted on opposite sides of said chamber and the same distance from the respective facing surface of said chamber.

7. A system as in claim 5 wherein up to three bags can be mounted in said cannister providing a large increase in the efficiency of said system.

8. A system as in claim 5 wherein said chamber and said cannister are both circular and said cannister is mounted within said chamber to have its exterior circular surface in abutting relation within the inner circular surface of said chamber.

9. A method for providing a uniform dose of X-ray beam irradiation to blood products transfusion bags, said method comprising in combination, a) mounting said bags in an irradiation chamber;

b) irradiating said bags from opposite sides of said bags at a same selected energy level to said bags to thereby provide a radiation energy to said bags which is substantially uniform throughout said bags; and d) reflecting said X-rays from a low Z high density material mounted around a cannister and directing said X-rays onto said bags, thereby operatively combining the X-ray energies from said opposite sides and the reflected X-ray energy into a total effective irradiation for said bags.

* * * * *